United States Patent [19]

Coggins et al.

[11] 3,944,496

[45] Mar. 16, 1976

[54] COMPOSITION FOR CHEMICAL MILLING REFRACTORY METALS

[76] Inventors: Dolphus L. Coggins, 8719 Evans Lane, Berkeley, Mo. 63134; Robert G. Werkema, 4736 Gatesbury Drive, St. Louis, Mo. 63129

[22] Filed: Apr. 30, 1973

[21] Appl. No.: 355,765

[52] U.S. Cl. ..... 252/79.3; 156/18; 252/79.4

[51] Int. Cl.[2] C09K 13/06; C09K 13/08; C23F 1/00

[58] Field of Search ..... 156/8, 18; 134/3, 41; 252/79.2, 79.3, 79.4

[56] References Cited

UNITED STATES PATENTS

| | | | |
|---|---|---|---|
| 2,981,610 | 4/1961 | Snyder et al. | 252/79.3 |
| 3,052,582 | 9/1962 | Snyder | 156/18 |
| 3,753,815 | 8/1973 | Burton et al. | 252/79.3 X |
| 3,788,914 | 1/1974 | Gumbelevicius | 156/18 |

*Primary Examiner*—William A. Powell

[57] ABSTRACT

This application describes a composition and a process of chemically milling refractory metals and their alloys. The composition comprises a combination of nitric acid, hydrofluoric acid, and phosphoric acid, and preferably includes a derivative of carbonic acid, such as carbamide. The composition is particularly useful in the chemical milling of beta titanium, alpha beta titanium, and alpha titanium alloys. Use of the composition of this invention results in reduced tolerances in the chemically milled article and also reduced hydrogen absorption in the titanium part which is chemically milled.

3 Claims, No Drawings

COMPOSITION FOR CHEMICAL MILLING REFRACTORY METALS

BACKGROUND OF THE INVENTION

It is very difficult to chemically mill titanium and other refractory metals other than the alpha alloys of titanium, because of the high affinity of beta and alpha beta alloys for hydrogen. High hydrogen absorption results in great internal stresses which tend to crack the metal. We have discovered that the combination of phosphoric acid, nitric acid, and hydrofluoric acid results in a chemical milling composition which has significant advantages over conventional etchants and the composition of Ser. No. 200,143, particularly if combined with carbamide.

In co-pending application of John Gumbelevicius Ser. No. 200,143, filed Nov. 18, 1971, now U.S. Pat. No. 3,788,914 assigned to the assignee of this application, there is described a chemical milling composition containing nitric acid, hydrofluoric acid, and carbamide which results in a substantial lowering of the hydrogen absorption in beta and alpha beta titanium.

The composition of this invention is an improvement of the composition of Ser. No. 200,143 in that it provides considerably better tolerances in the chemically milled workpiece as well as causing even less hydrogen absorption in beta titanium and alpha beta titanium during chemical milling.

Another advantage of this invention is that it provides an even, controlled etch rate with a reduction of tapering and grooving problems usually associated with the use of conventional nitric-hydrofluoric acid mixtures. This significantly improves the operation of and tolerance control in chemical milling procedures. Another advantage of this composition is an improved solution life which results from the production of an easily removable, considerably softer, sludge-like scale in the etch tank. This allows easier clean up and higher dissolved metal loadings in the solution before it must be replaced.

SUMMARY OF THE INVENTION

The present invention comprises a chemical milling solution for milling refractory metals, particularly titanium, and their alloys, specifically beta and alpha beta titanium alloys, with little hydrogen absorption in the alloys, improved tolerance control, and longer solution life. The solution comprises nitric acid, phosphoric acid, hydrofluoric acid and derivatives of carbonic acid. In addition, small percentages of surfactants may be added to the solution.

DETAILED DESCRIPTION

The composition of this invention comprises a combination of nitric, hydrofluoric and phosphoric acids. An organic addition, such as carbamide, may be added to provide an equivalent metal dissolving rate at considerably lower hydrofluoric acid concentrations than when the chemical milling solution does not contain this additive, and to reduce hydrogen absorption.

The preferred formula for the etching solution is as follows:

Preferred Solution Makeup

| | |
|---|---|
| Hydrofluoric Acid | 85 g./l |
| Nitric Acid | 400 g./l |
| Phosphoric Acid | 300 g./l |

-continued

Preferred Solution Makeup

| | |
|---|---|
| Urea | 25 g./l |

After the foregoing described solution is made, titanium scrap or titanium alloy scrap is dissolved in the solution to provide a metal concentration of about 6 g./l. Scrap dissolution takes place at a temperature of 100° to 125° F. A surfactant, Sulframin 1298, supplied by the Witco Chemical Company, is added to obtain a surfactant concentration of 0.0001 g./l. Sulframin 1298 is a trade name of dodecyl benzene sulfonic acid. This particular surfactant is not bio-degradable, but appears to be more stable in the chemical milling solution than the bio-degradable types, such as the linear sulfonic acid version which may be used, if desired. The surfactant is added to eliminate the small amount of thin out in the top radius of the chemically milled area when the specimen is chemically milled in the vertical position in the solution. The solution is heated to the operating temperature of about 125° to about 135° F. preferably 130°F. Additional hydrofluoric acid is added, if required, to obtain the desired metal etch rate of 0.001 to 0.0014 inches/minute/surface. The operational parameters of the chemical milling solution are as follows:

Preferred Solution Operation Range

| Ingredient | Quantity |
|---|---|
| Hydrofluoric acid | Sufficient quantity to maintain an etch rate of 0.001 to 0.0014 inches/minute/surface |
| Nitric acid | 370–470 g./l |
| Phosphoric acid | 270–350 g./l |
| Urea | 18–35 g./l |
| Surfactant | Sufficient quantity to maintain a surface tension of about 45–60 dynes/cm. of a well mixed solution diluted 1 to 1 with water, measured at 70° ± 5°F. with a Fisher Surface Tensiomat |

EXAMPLE NO. I

The following is a specific detailed disclosure of a preferred process of chemically milling titanium, specifically beta titanium alloys.

1. The specimen (beta titanium alloy) is cleaned with a suitable solvent such as trichloroethylene, and then pickled in a standard nitric hydrofluoric acid pickle solution (30 volume percent $HNO_3$, 3 volume percent HF) at ambient temperature for 1 minute. This pretreatment is necessary for removal of oil, grease, and other contaminants normally found on parts in metal fabrication. The purpose of this cleaning is twofold: (a) to eliminate contamination of the chemical milling solution, and (b) to provide a clean surface for proper maskant adhesion. After cleaning, the specimen is immersed in a hot (150°–215°F.) caustic base sodium hydroxide solution to provide an oxide conversion coating on the specimen surface. After immersion in the hot caustic bath, the specimen is rinsed in tap water and then air-dried. The use of the conversion coating is to provide enhanced maskant adhesion. Both factors are important to produce acceptable parts; however, these factors do not affect hydrogen absorption and thus are incidental with respect to this invention.

2. A rubber base maskant is then applied to the specimen by spraying or by immersion. The maskant used is one of several proprietary compounds available commercially. Suitable products include but are not necessarily limited to, Turco 570 made by Turco Products, Inc., and Dapco 1200A made by Deutsch Aircraft Products Company. The step is well known in the art.

3. The coated specimen is permitted to dry at room temperature (about 76°F.) until it is in a tack free condition. This takes about 20 minutes.

4. Dipping and drying between dipping is repeated three more times to apply four coats of mask which provides about a 0.016 in. thick coating on the specimen.

5. After the final coat, the specimen is kept at room temperature for about 6 hours to permit evaporation of solvents from the coating.

6. The masked specimen then is baked at 200°F. for 1 hour. This treatment polymerizes the coating and renders it inert to the chemical milling solution.

7. The chemical milling template, previously made from steel, is applied to the specimen. The template is designed to serve as a guide for the scribing knife to obtain the chemical milling pattern. The knife used is a commercial type X-Acto scribing knife.

8. After all the lines for the chemical mill pattern are cut through the maskant, but not into the metal, the template is removed and the maskant is peeled by hand from the areas to be chemically milled.

9. The specimen is transferred into the chemical milling solution. The solution composition is as follows: 400 g. of nitric acid, 85 g. of hydrofluoric acid, 300 grams of phosphoric acid, 25 g. of carbamide, 0.0001 g. dodecyl benzene sulfonic acid to 50 g./l dissolved titanium or titanium alloy, and water to make a total of one liter. The temperature of the solution is at 130° ± 5°F., and is agitated by means of a magnetic stirrer. The specimen is suspended in the solution using plastic coated wire and is left in the chemical milling solution for 10 minutes.

10. After 10 minutes, the specimen is removed from the chemical milling solution, rinsed with cold water, and the amount of metal removal is measured using a micrometer. 0.013 in. of metal was removed which is a metal removal rate of 0.0013 in. per minute.

11. As the desired metal removal is 0.030 inches (half the thickness of the test specimens), the test specimen is returned to the chemical milling solution for an additional 11 minutes, to obtain the desired metal removal.

12. The specimen is removed, rinsed with cold water and the metal removal is checked again with a micrometer to ascertain that 0.030 in. of metal have been removed.

13. The maskant from areas which had not been chemically milled is removed by hand peeling.

The foregoing process can be used to chemically mill other titanium alloys and refractory metals and their alloys. The following alloys in addition to titanium are considered as refractory: columbium, molybdenum, tungsten, and tantalum.

"Hot spots" and uneven etch rate over the part being chemically milled are eliminated by the addition of phosphoric acid to the composition of Ser. No. 200,143. Tapering and grooving problems are greatly reduced. A direct comparison of the tolerance spread obtainable with a standard etchant of Ser. No. 200,143 and with the improved etchant containing phosphoric acid is provided in Table I. Both etchants are 7.0 N in nitric acid, contain 50 grams/liter carbamide and sufficient hydrofluoric acid to provide an etchant rate of 1 mil./minute/surface at an etchant temperature of 130°F. Both etchants are identical except that the improved etchant of this invention has added phosphoric acid (2.5 M.). Pockets 2 inches wide by 18 inches long were chemically milled to a nominal remaining stock thickness of 0.020 inches in Ti-6AL-6V-2SN alloy having an initial thickness of 0.062 inches.

TABLE I

CHEMICAL MILL TOLERANCE COMPARISON

| | Tolerance Spread, Inches | |
|---|---|---|
| | Milled Vertically | Milled Vertically, Rotated end for end ½ way through operation |
| Etchant as described in Serial No. 200,143 | 0.023 | 0.006 |
| Improved Etchant | 0.006 | 0.002 |

Thus, it is seen that there is a considerable reduction in the tolerance spread obtained by the use of the new, improved etchant as compared with the etchant containing the basic nitric acid-hydrofluoric acid mix.

The above tabulated tolerances were obtained on flat specimens. One other very important feature of this improved chemical milling formulation is that metal removal rates in both the horizontal and vertical planes are essentially identical (within 10 percent of each other) as opposed to the 25 to 30 percent higher metal removal rate in the horizontal over that of the vertical plane of the composition described in Ser. No. 200,143. This is especially important in maintaining overall tolerances when chemically milling formed parts having complex configurations which cannot be rotated to compensate for this etch rate difference.

The addition of phosphoric acid to a conventional nitric-hydrofluoric acid etchant results in a considerable reduction in the amount of hydrogen absorbed during the chemical milling operation. Hydrogen levels in alphabeta alloys chemically milled in an etchant composed of nitric, hydrofluoric, and phosphoric acids approximate those levels obtained using a nitric-hydrofluoric etchant containing carbamide. Addition of both phosphoric acid and carbamide to the standard nitric-hydrofluoric acid etchant of Ser. No. 200,143 produces a still further reduction in amount of hydrogen absorbed. Data in Table II show hydrogen absorption to be approximately 33 percent lower for specimens milled in the new etchant containing phosphoric acid as compared to specimens milled in the Ser. No. 200,143 etchant. Both etchants compared in this table contained carbamide and all conditions of the runs were identical except for the incorporation of phosphoric acid in the new etchant. The Runs were made using the same compositions and under the same chemical milling conditions as described in the process of Table I except that the specimens were milled to a remaining stock thickness of 0.030 inch.

The decrease in hydrogen absorption with the improved etchant is attributed to the increased corrosion potential of the dissolving reaction due to the higher hydrogen ion concentration which results in a still further decrease in hydrogen gas evolution during the chemical milling operation.

TABLE II

COMPARISON OF HYDROGEN ABSORPTION IN CHEMICALLY MILLED Ti-6Al-6V-2Sn ALLOY

| Run No. | Initial Thickness Inches | Initial Hydrogen Content ppm | Hydrogen Content After Chemical Milling, ppm: Etchant Described in Ser. No. 200,143 | Hydrogen Content After Chemical Milling, ppm: Improved Etchant |
|---|---|---|---|---|
| 1 | 0.080 | 71 | 100 | 111 |
| 2 | 0.071 | 171 | 178 | 147 |
| 3 | 0.090 | 45 | 103 | 113 |
| 4 | 0.063 | 84 | 143 | 112 |
| 5 | 0.080 | 47 | 79 | 62 |
| 6 | 0.071 | 60 | 113 | 90 |
| 7 | 0.063 | 83 | 136 | 101 |
| | | | Average 122 | 105 |

Hydrogen content of the milled article is measured in parts per million (ppm). Aeronautical materials specifications state the maximum permissible hydrogen concentrations are 150–200 parts per million, depending upon the titanium alloy involved. These figures are conservative, and for less critical applications than aerospace vehicles higher hydrogen concentrations could be tolerated. It should be noted that hydrogen values shown in this application are based on the use of annealed alpha beta titanium. Forming of alpha-beta titanium at temperatures in excess of 110°F. produce changes in the material which result in considerably higher hydrogen absorption (350–500 ppm) during the chemical milling operation. Hot formed alpha-beta titanium can be stabilized at lower temperatures after forming to provide hydrogen absorption equivalent to that obtained in annealed material. Another significant improvement in this invention is its increased solution life, that is, the solution can stay in contact with the metal being milled for a longer period of time without creating a scale problem.

Optimum etchant composition, prior to the introduction of phosphoric acid to the etchant makeup, was a nitrichydrofluoric acid solution which contained carbamide at a nominal 25 g./l concentration. use of this type etchant produced an extremely hard scale which resulted in high tank clean up costs and excessive maintenance on valves and pump seals. Solutions of this composition are generally discarded at relatively low dissolved metal levels to minimize scale problem. The addition of phosphoric acid to this type etchant composition produces a considerably softer, sludge-like scale, which is easily removable and does not contribute appreciably to maintenance problems. This allows use of the present etchant with dissolved metal holdings up to 50 percent higher than were allowable previously.

The chemical milling solution used in this invention preferably contains a surfactant of a type compatible with a strong, oxidizing acid mixture. The surfactant is added to eliminate the small amount of thin out in the upper radii of pockets milled in the vertical plane. The surfactant amount is normally quite small. Additions are made to maintain surface tension within proper limits. Suitable surfactants include dodecyl benzene sulfonic acid and alkyl benzene sulfonate.

The chemically milling solution contains preferably 50% by volume of commercially available 67.8 wt. % nitric acid. The range of nitric acid concentration can be varied between about 210 and about 630 grams of pure nitric acid per liter of final solution. The range can also be expressed in Normality (N) which is the term used to describe one gram equivalent weight of reactive material per liter of solution and is about 3 to about 9 N., preferably about 6 N. The use of nitric acid is critical.

Between 4 and 16% by volume of commercially available hydrofluoric acid can be used, although 7 to 10% of said hydrofluoric acid is preferred. These ranges can be expressed as enough hydrofluoric acid to provide an etch rate of about 0.8 to about 1.6 mils/minute/surface at operating temperature or as 87 to 126 g. of 70% hydrofluoric acid per liter of final solution. Hydrofluoric acid is preferred, but fluoride salts such as, lithium fluoride, ammonium fluoride, sodium fluoride, and the like, can be used as the fluoride producing material.

The milling solution contains preferably 25% by volume of commercially available 75 wt. % phosphoric acid. The range of phosphoric acid concentration can be varied between about 98 and about 590 grams of pure phosphoric acid per liter of final solution. This can also be expressed in molarity with a range of about 1 to about 6.0 M. phosphoric acid, preferably about 3 M. The use of phosphoric acid is critical. Addition of phosphate ion in the form of phosphoric acid ($H_3PO_4$) is preferred, although other phosphate ion containing compounds may be used.

Carbamide is the preferred cabonic acid derivative, but others can be used, such as, urea nitrate, urea oxalate and semi-cabazide. The carbamide is present in amount of at least 10 grams per liter of final solution. Preferably the range is from about 15 to about 50 grams per liter (based on carbamide). The use of carbamide plus phosphoric acid decreases the hydrogen absorption as seen in Table II. The solution can be operated with the omission of carbonic acid derivative. Operation without the carbonic acid derivative requires higher hydrofluoric acid concentrations to obtain the equivalent etch rate, and for this reason the addition of this compound in preferred.

The temperature range of the chemical milling process may be between about 90°F. and about 140°F., although the preferred range is about 120° to about 130°F.

Inert coatings such as neoprene or high melting wax are used to cover the areas of the titanium which are not to be chemically milled. Such materials are commercially available.

The time of chemical milling varies widely depending on the amount of metal removal. Normally the rate of metal removal is about 0.0012 inches per minute per surface. The majority of present aerospace parts require metal removal of about 1/16 inch which would take about 0.85 hours in chemical milling time. The rate of metal removal of this invention is approximately 0.0012 inches per minute per surface.

The invention is intended to cover all changes and modifications of the examples of the invention herein chosen for purposes of the disclosure, which do not constitute departures from the spirit and scope of the invention.

What is claimed is:

1. A composition for chemically milling and surface treating refractory metals and their alloys comprising per liter A. about 210 to about 630 g. pure nitric acid equivalent, B. phosphate ion producing material equivalent to about 98 to about 440 g. pure phosphoric acid, C. an amount of fluoride producing material sufficient to provide the equivalent of about 61 to about 88 g. of pure hydrofluoric acid, and D. a derivative of carbonic acid in an amount equivalent to at least about 15 grams of carbamide.

2. The composition of claim 1 containing about 0.00005 to about 0.0003 g./l surfactant.

3. The composition of claim 1 wherein the fluoride material is hydrofluoric acid and the carbonic acid derivative is carbamide.

* * * * *

UNITED STATES PATENT OFFICE

CERTIFICATE OF CORRECTION

Patent No. 3,944,496 Dated March 16, 1976

Inventor(s) Dolphus L. Coggins and Robert Werkema

It is certified that error appears in the above-identified patent and that said Letters Patent are hereby corrected as shown below:

[75] Inventors: Dolphus L. Coggins, 8719 Evans Lane, Berkeley, Mo. 63134; Robert G. Werkema, 4736 Gatesbury Drive, St. Louis, Mo. 63129

[73] Assignee: McDonnell Douglas Corporation, St. Louis, Missouri

Signed and Sealed this

Thirteenth Day of July 1976

[SEAL]

*Attest:*

RUTH C. MASON
*Attesting Officer*

C. MARSHALL DANN
*Commissioner of Patents and Trademarks*